United States Patent [19]

Bruneau

[11] 4,360,180

[45] Nov. 23, 1982

[54] DEVICE FOR LOCKING THE DRAWING BOARD OF A DRAWING TABLE ASSEMBLY

[75] Inventor: Alain Bruneau, Montferrand le Chateau, France

[73] Assignee: Jeandal, France

[21] Appl. No.: 120,297

[22] Filed: Feb. 11, 1980

[30] Foreign Application Priority Data

Feb. 12, 1979 [FR] France ..... 79 03926
Jul. 26, 1979 [FR] France ..... 79 19256

[51] Int. Cl.[3] ..... A47F 5/12

[52] U.S. Cl. ..... 248/162.1; 108/6; 108/146

[58] Field of Search ..... 248/162.1, 123.1, 337, 248/335, 411, 412, 161; 108/146, 10, 6, 8

[56] References Cited

U.S. PATENT DOCUMENTS

| | | | |
|---|---|---|---|
| 1,859,456 | 5/1932 | Nestler | 108/10 X |
| 2,318,458 | 5/1943 | Boren | 108/146 |
| 3,079,726 | 3/1963 | May | 108/10 X |
| 3,213,809 | 10/1965 | Kritske | 108/146 |
| 3,370,556 | 2/1968 | Kool | 108/146 X |
| 3,467,352 | 9/1969 | Bohler | 248/412 |
| 3,504,643 | 4/1970 | Burst et al. | 108/146 X |
| 3,715,997 | 2/1973 | Barth | 108/146 |
| 3,854,428 | 12/1974 | Fullenkamp | 108/146 |
| 4,033,543 | 7/1977 | Ponzellini | 248/412 |
| 4,111,389 | 9/1978 | Gundlach et al. | 248/162.1 |
| 4,195,578 | 4/1980 | Benoit | 108/146 |

FOREIGN PATENT DOCUMENTS

| | | | |
|---|---|---|---|
| 1265937 | 4/1968 | Fed. Rep. of Germany | 108/10 |
| 197141 | 12/1958 | Sweden | 108/10 |
| 367951 | 4/1963 | Switzerland | 108/10 |
| 522846 | 11/1976 | U.S.S.R. | 108/10 |

*Primary Examiner*—James T. McCall
*Attorney, Agent, or Firm*—Robert E. Burns; Emmanuel J. Lobato; Bruce L. Adams

[57] ABSTRACT

A drawing board is mounted on a support column slidably guided by a vertical pedestal structure and is supported by a cable passing over a pulley which is urged upwardly by a gas cylinder to counterbalance the weight of the drawing board. Opposed brake shoes mounted by toggle linkage on an inner support member are biased into engagement with inner surfaces of the support column by springs acting on sliding pivots of the toggle linkage. The normally engaged brakes are releasable by a foot pedal connected by a rod with a sliding yoke on which the sliding pivots are mounted. The rod is connected with the yoke by engaging in a notch in an edge of the yoke. In the event of breakage of the cable or failure of the counterbalancing cylinder, a safety device is actuated to disconnect the rod from the sliding yoke and thereby permit spring actuation of the brakes to prevent the drawing board from falling.

10 Claims, 8 Drawing Figures

DEVICE FOR LOCKING THE DRAWING BOARD OF A DRAWING TABLE ASSEMBLY

FIELD OF THE INVENTION

This invention relates in general to drawing boards or tables of the type supported by a frame structure and adjustable both for tilt and height in relation to the floor, notably a device for locking the board proper which is supported by, and enclosed in, central column slidably mounted in a pedestal structure comprising guide means and supported in a turn by a base plate, a safety device being associated with the locking device for preventing the board from falling in case of breakage of the drawing board suspension means.

DESCRIPTION OF THE PRIOR ART

Hitherto known drawing boards of the type broadly set forth hereinabove comprise in most instances two columns or stands supporting the board proper, and the locking means are assisted by balancing means, mostly in the form of springs reacting against the pedestal structure and connected via a cable to the base of the column, this cable passing over a pulley secured to the pedestal structure at a suitable level.

In order to maintain a substantially constant spring-loaded tensile effort on the cable, the pulley is generally of the spiral type, i.e. formed with a helical groove.

In more recent drawing board designs, gas cylinders of the type currently associated with tail gates of automotive vehicles are used.

The safety devices of some known drawing board constructions comprise a feeler affixed to means supporting the vertical adjustment control device. This feeler is urged by spring means for engagement with the cable and the brake shoe control rod extends through said feeler.

Existing drawing board structures are objectionable chiefly because the locking means are not controlled by a safety device acting instantaneously in case of breakage or disconnection of the balancing cable.

SUMMARY OF THE INVENTION

It is the essential object of this invention to provide, within the column or columns supporting the drawing board proper, locking means permitting the vertical adjustment of the board, said means being sufficiently simple and efficient to operate instantaneously under the control of a safety device responsive to the breakage of disconnection of the balancing cable.

For the purpose, the locking device according to this invention is characterised in that it comprises at least two brake shoes diametrally opposed in relation to the longitudinal axis of the sliding column and constantly urged by mechanical means against the inner surface of this column, and that the means controlling said brake shoes operate by temporarily suppressing the action of said mechanical means.

This arrangement is advantageously mainly because, since the brakes are constantly locked, they must be released temporarily for adjusting the vertical position of the drawing board, and furthermore if during the short time period necessary for accomplishing this adjustment a rupture of the cable of the balancing device took place, the action of the safety device constantly feeling said cable will restore immediately the normal locking action of the brakes.

More particularly, a gas-filled cylinder or piston-and-cylinder unit is provided for balancing the weight of the drawing board during the vertical adjustment thereof, this cylinder reacting against the base plate with one end and supporting at its opposite end a pulley over which a cable is passed.

This cable is connected at one end to the base plate and at the other end to the lower end of the column, i.e. the end opposite the end supporting the drawing board.

The locking device of this invention departs from the prior art in that it is independent of safety means confirming the pressure exerted by the brake shoes against the inner wall of the supporting column, said safety means consisting essentially of a rocker having its fulcrum positioned at mid-height of the column support, one of the rocker arms being coupled to a balancing spring while the other arm supports one cable end, the other cable end being anchored to the base of the movable column, the brake shoe control rod extending through the cable end supporting rocker arm. On the other hand, said safety means are enclosed in the sliding cylinder.

The chief advantage of this improved safety device arrangement lies in its extreme simplicity and its instantaneous efficiency in case of cable failure.

Other advantages will appear as the following description proceeds with reference to the attached drawing illustrating diagrammatically by way of example typical forms of embodiment of the invention.

DESCRIPTION OF THE PREFERRED EMBODIMENTS

Figure 2:
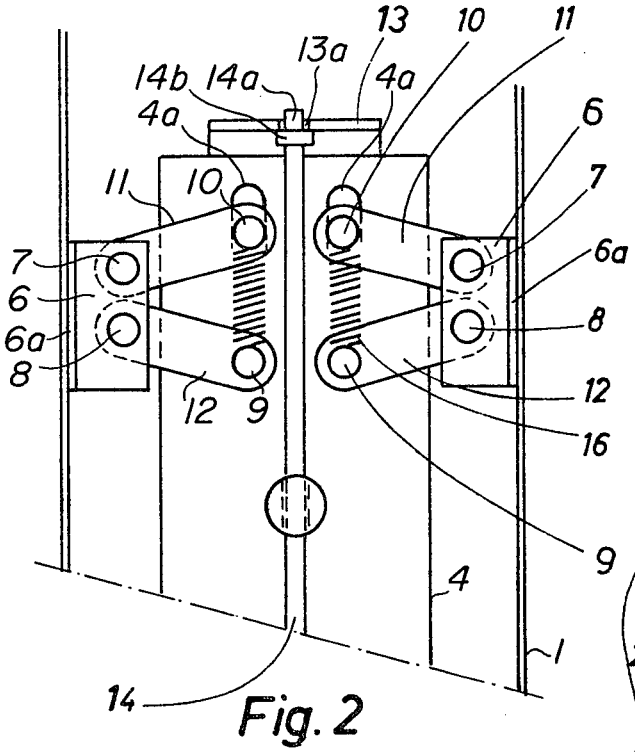
FIG. 2 is a diagrammatic view showing the mode of operation of the brake means and of the mechanical means associated therewith for producing a constant brake application.

The drawing board locking device comprises at least two diametrally opposed brake shoes 6 of which the contact faces, covered with a lining 6*a* of sufficiently strong and self-gripping material, are shaped to conform to the inner cylindrical surface of a sliding column 1 guided by suitable means 3 in a fixed vertical pedestal structure 2.

The brake shoes 6 are kept in a plane parallel to the inner surface of column 1 by means of a toggle or deformable isosceles trapezium of which the four corners consist of pivot pins 7,8,9 and 10 pivotally mounting four links 11,22 of equal length. The pivot pins 7,8 are secured to the brake shoe 6 in a plane parallel to the inner surface of column 1. Pivot pin 9 is secured to a central support 4 in a plane parallel to the preceeding one, the same applying to pivot pin 10 adapted to slide in said plane in a slot 4*a* in central support 4 so as to move the brake shoe 6 towards or away from the braking surface by distorsion of the toggle. A tension spring 16 acts between pivot pins 9 and 10 toward pivot pin 9 and thereby brings inner ends of links 11 and 12 toward one another, which has the effect of moving the brake shoe outwardly into engagement with the inner surface of the column 1. The pivot pin 10 associated with each link 11 is affixed to a yoke member 13 concentric to, and slidably mounted within, the aforesaid support 4.

The longitudinal movement of yoke member 13 in support 4 is controlled by means of a rod 14 coupled to a treadle 15 projecting outside the pedestal structure 2 The upper end 14*a* of the rod 14 is received in a notch 13*a* of the yoke member 13. A collar 14*b* on the rod 14 engages under the yoke member 13 so as to move it upwardly by upward movement of the rod 14.

Depressing the treadle 15 will move the rod 14, yoke member 13 and pivot pins upwardly against the tension of springs 16 to release the braking action and thereby permit the vertical adjustment of the board position.

FIG. 2 illustrates the brake shoes 6 in their column locking positions. The sliding pivot pin 10 is urged towards the underlying pivot pin 9 as a consequence of the tractive effort exerted on pivot pin 10 by the coil tension spring 16 anchored to said lower pivot pin 9 to spread the brake shoes apart and thereby press them against the inner surfaces of column 1.

Thus, when the drawing-board supporting column 1 is released by depressing the treadle 15 fulcrumed to a pivot pin 15*a*, the vertical rod 14 actuated by the treadle will cause the yoke member 13 to slide away from the base or floor 5. Of course, as pivot pin 10 moves away from pivot pin 9, the links 11 cause the brake shoes 6 to relieve their pressure against the column or cylinder 1.

When the treadle 15 is released, the force of spring 16 will move the pivot pin 10 toward pivot pin 9, thus locking again the column 1.

Figure 3:
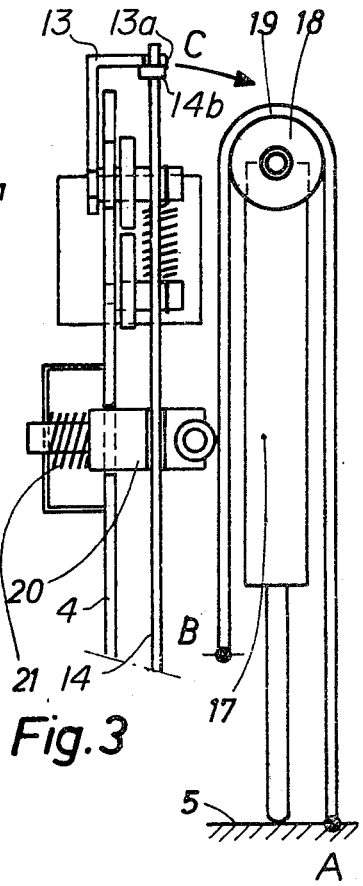
FIG. 3 is a diagrammatic view showing a locking and balancing device comprising a gas cylinder and a safety device associated therewith.
Figure 1:
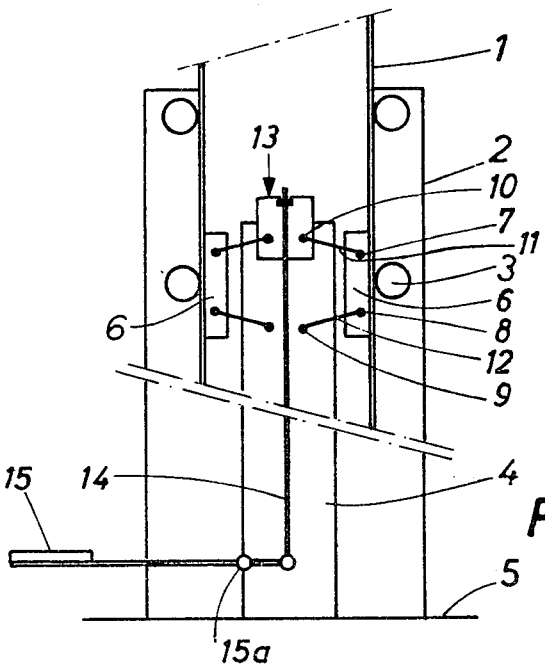
FIG. 1 is a general diagrammatical view of the drawing-board locking device.

FIG. 3 illustrates a device for balancing the weight of the drawing board proper (not shown) and a safety device associated with said balancing device.

The weight of the drawing board and also of the column 1 supporting it is balanced by a gas cylinder piston unit 17 bearing on the base plate or floor 5 and provided at its upper end with means for rotatably mounting a grooved pulley 18 over which a cable 19 is passed. This cable 19 has one end anchored at A to the base plate 5 and its other end attached to B to the end of column 1 opposite the end supporting the drawing board.

Therefore, this cable 19 carries the total weight of the movable portion of the drawing board structure.

A safety device is provided for actuating the locking device instantaneously in case of failure of cable 19.

This safety device comprises a feeler 20 carried by the central support 4 and urged against the cable 19 by spring means 21 so as to constitute a kind of cable tensioning device.

The feeler body 20 has a transverse vertical hole formed therethrough which is freely and slidably engaged by the release control rod 14.

In case of cable breakage, the feeler 20 urged by its spring 21 will push the rod 14 in the direction of the arrow C and thus expell this rod 14 from its notch 13*a* in yoke member 13, thus releasing the latter. Consequently, springs 16 will move the pivot pins 10 towards pivot pins 9, thus spreading the brake shoes 6 apart to press them into engagement with inner surfaces of the column 1.

Figure 4:
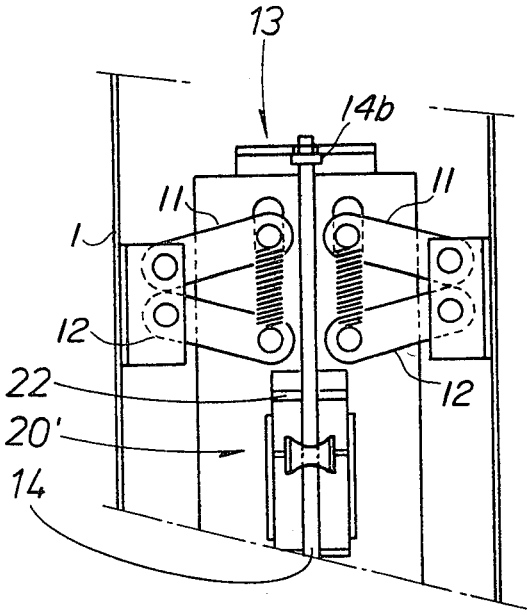
FIG. 4 is a modified embodiment of the structure of FIG. 2.
Figure 5:
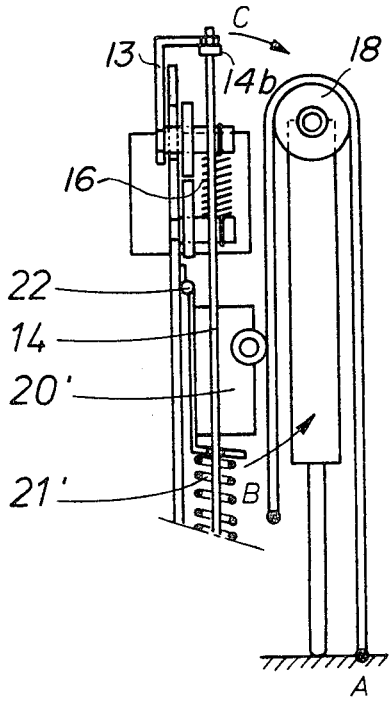
FIG. 5 is a modified embodiment of the structure of FIG. 3.

FIGS. 4 and 5 illustrate a modified form of embodiment of the safety device in which the feeler 20' is pivoted to a hinge 22 secured to the support 4 of the locking device.

A spring 21' reacting against this support 4 and suitably spaced from hinge 22 exerts a predetermined pressure on feeler 20', thus producing a certain torque about this hinge.

Since the cable 19 counteracts this torque, as shown at B in FIG. 5, in case of cable failure the feeler 20' will tilt about the hinge 22 and carry along the rod 14 in the direction of the arrow C to desengage the upper end of the rod from the notch 13*a* in the yoke member 13, thereby permitting the springs 16 to press the brake shoes 6 against the column 1 as described above.

This modified form of embodiment of the safety device is advantageous in that it becomes immediately operative in case of cable breakage, since any frictional contact is eliminated, and furthermore the overall dimensions and the manufacturing cost of this device are reduced considerably.

Figure 6:
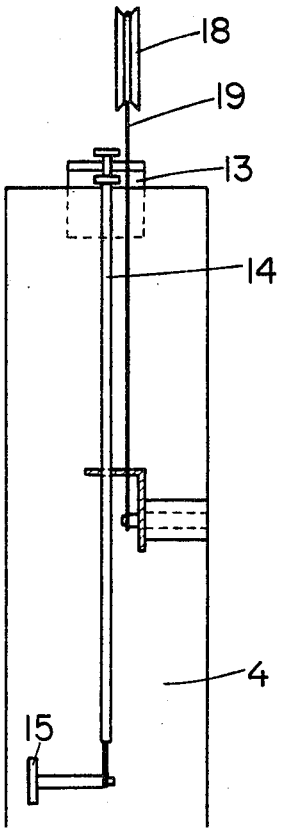
FIGS. 6 and 7 illustrate a modified embodiment of the safety device.
Figure 7:
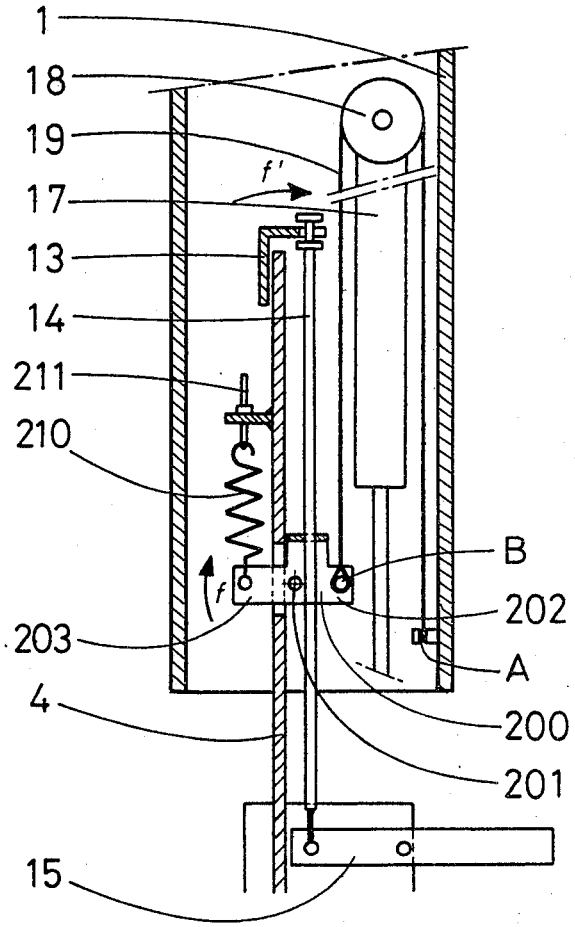
Figure 8:
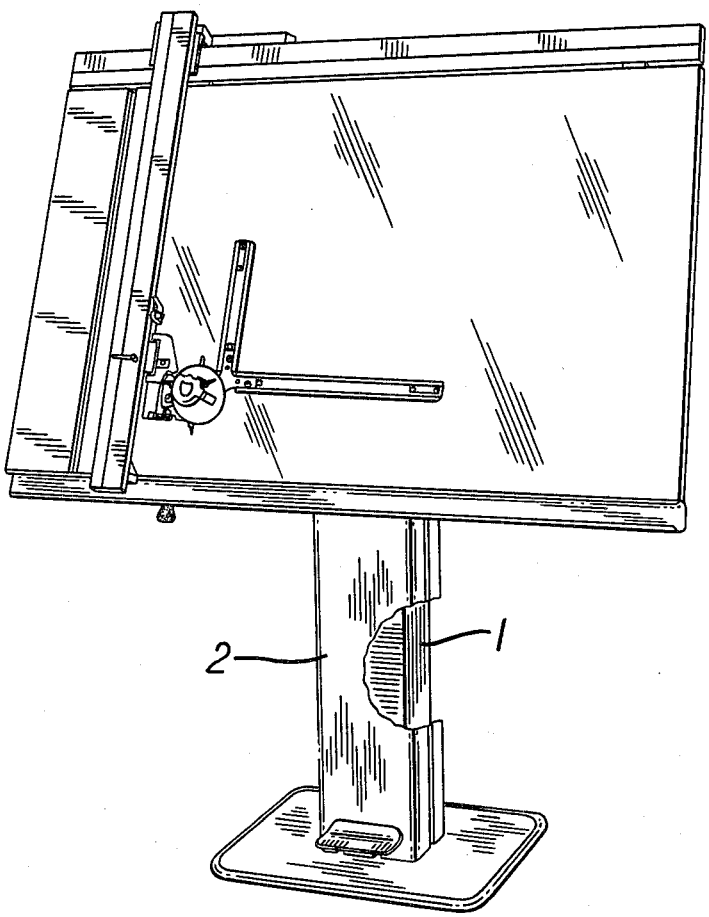
FIG. 8 is a perspective view of a drafting table in which a locking device in accordance with the invention is incorporated.

FIGS. 6 and 7 of the drawings illustrate another modified form of embodiment of the safety device in which mechanical means are also provided on the member 4 supporting the locking brake shoes (not shown) inside the sliding column 1 supporting the drawing board proper (not shown), parallel to the drawing board balancing gas cylinder piston unit 17.

At about one-half of the stroke accomplished by column 1 on support 4 is a pivot pin 201 constituting the fulcrum of a rocker 200 supporting with one arm 202 the anchorage point B of cable 19, the latter passing over the end pulley 18 carried by the gas cylinder piston unit 17 and being attached at a point A to column 1, the other arm 203 of the rocker being attached to a drawing board balancing spring 210.

The arm 202 of rocker 200 has a hole formed therein through which the treadle rod 14 extends, this rod, as shown having one end pivotally attached to the treadle 15 controlling the release of the brake means associated with column 1, and the other end adapted to control the brake shoes.

A turnbuckle or like device 211 is provided for adjusting the tensile effort exerted by spring 210 on the arm 203 of rocker 200.

It is obvious that this rocker 200 is balanced when the tractive effort exerted on arm 203 is equal to the tractive effort exerted by cable 19 on arm 202.

In case of rupture of cable 19, or if the gas pressure in cylinder 17 drops, the traction-stressed spring 210 will cause the rocker 200 to tilt in the direction of the arrow (f), thus causing the brake release rod 14 to move angularly in the direction of the arrow f'.

Thus, the upper end of rod 14 is disengaged from yoke member 13 controlling the locking device, and consequently the treadle 15 is disconnected from said yoke member 13.

The brakes thus remain in their locked condition, so that column 1 cannot move downwards. Consequently, any detrimental consequence resulting from an instinctive reaction likely to induce the draughtsman to depress the release pedal 15 is safely prevented.

In short, the safely feature is obtained by using a single set of brake shoes constantly kept in their applied condition through failure-proof mechanical means, except when it is desired to adjust the vertical position of the drawing board.

Although specific forms of embodiment of this invention have been described hereinabove and illustrated diagrammatically in the accompanying drawings, it will readily occur to those skilled in the art that various modifications and changes may be brought thereto without departing from the basic principles of the invention as set forth in the appended claims.

What is claimed is:

1. In a drawing table assembly comprising a drawing board mounted on a support column guided for vertical movement in a pedestal structure and supported by a cable passing over a pulley biased in a direction to counterbalance the weight of the drawing board, a safety device comprising a vertical inner support member inside said column, brake means comprising brake shoes mounted by linkage on opposite sides of said inner support member and engageable with inner surfaces of opposite sides of said support column, spring means acting on said brake shoes to press them into frictional engagement with said support column, means for releasing said brake means, said brake releasing means comprising a release member connected with said brake shoes and movable to withdraw said brake shoes from said inner surfaces of said support column against the action of said spring means, a foot treadle, and control member connecting said foot treadle with said release member for operation of said release member by said foot treadle to release said brake means, and safety means for sensing tension in said cable and for disconnecting said control member from said release member upon loss of tension in said cable, whereupon said brake shoes are pressed into engagement with said support column by said spring means.

2. A safety device according to claim 1, in which said release member is mounted on said inner support member and is provided in an edge with a notch, and in which said control member comprises a rod connected at one end with said treadle and having a second end releasably engaged in said notch.

3. A safety device according to claim 2, in which said safety means comprises a feeler and second spring means for pressing said feeler against said cable, said feeler having an aperture through which said rod passes and being displaced by said second spring means upon loss of tension in said cable to displace said rod laterally to disengage said second end thereof from said notch in said release member.

4. A safety device according to claim 3, in which said feeler is slidably mounted on said inner support member for movement toward and away from said cable, said second spring means urging said feeler toward said cable.

5. A safety device according to claim 3, in which said feeler is pivotally mounted on said inner support member and said second spring means acts on said feeler in a direction to press a portion thereof into engagement with said cable.

6. A safety device according to claim 2, in which said safety means comprises a rocker pivotally mounted at its mid-point on said inner support member at about the mid-height of said inner support member, in which said cable has one end attached to one end of said rocker, passes up over said pulley and has the other end attached to said support column near its lower end, and in which a spring acts between the other end of said rocker and a bracket on said inner support member to balance the pull of said cable, said rod passing through an aperture in said rocker displaced vertically from its pivot and being displaced laterally by the pivoting of said rocker upon loss of tension in said cable to disengage said second end of said rod from said notch in said release member.

7. A safety device according to claim 1, in which said linkage for each brake shoe comprises two links each pivotally connected at one end to said brake shoe, one of said links being pivotally connected with said inner support member by a fixed pivot and the other of said links being connected with said inner support member by a sliding pivot, said link being arranged in a deformable trapezium pattern, whereby the brake shoe is moved toward or away from the inner surface of said support column by the sliding of said sliding pivot.

8. A safety device according to claim 7, in which said spring means acts on said sliding pivot in a direction to move the brake shoe toward the inner surface of said support column.

9. A safety device according to claim 8, in which said release member is connected with said sliding pivot for moving said sliding pivot in a direction to move the brake shoe away from the inner surface of said support column.

10. A safety device according to claim 1, in which said pulley is mounted at one end of a vertical gas cylinder-piston unit having its other end supported by a base of said pedestal structure.

* * * * *